United States Patent [19]

Marconi

[11] 4,085,639

[45] Apr. 25, 1978

[54] BLANKING DIE AND HOLDER CONSTRUCTION FOR PUNCH PRESSES

[76] Inventor: Joseph Marconi, 428 Jensen Rd., Vestal, N.Y. 13850

[21] Appl. No.: 660,271

[22] Filed: Feb. 23, 1976

Related U.S. Application Data

[62] Division of Ser. No. 564,658, Apr. 3, 1975, Pat. No. 3,965,784.

[51] Int. Cl.[2] ..... B26D 7/18

[52] U.S. Cl. ..... 83/157; 83/552; 83/685; 83/690; 83/698

[58] Field of Search ..... 83/160, 552, 685, 690, 83/698, 157

[56] References Cited

U.S. PATENT DOCUMENTS

| | | | |
|---|---|---|---|
| 1,288,054 | 12/1918 | Lane | 83/690 |
| 1,940,883 | 12/1933 | Rollings | 83/552 |
| 2,364,401 | 12/1944 | Stellin | 83/690 |
| 2,920,913 | 1/1960 | Antila | 83/698 |
| 3,777,601 | 12/1973 | Strandell | 83/685 |

*Primary Examiner*—Donald R. Schran
*Attorney, Agent, or Firm*—Frederick E. Bartholy

[57] ABSTRACT

A blanking die comprises a relatively thin die plate having a cutout into which the punch of the press, upon blanking operation, forces the material to be cut to form the required part blank. A holder of sturdy construction is provided onto which the thin die plate is removably mounted. Slidably positioned within the holder is a reciprocating support block which, upon blanking operation, underlies the thin die plate in order to reinforce it against the impact of the punch. After the blanking cycle, the support block is moved either to eject the part blank or to allow the latter to fall through an opening in the holder.

1 Claim, 14 Drawing Figures

BLANKING DIE AND HOLDER CONSTRUCTION FOR PUNCH PRESSES

This is a division of my prior application, Ser. No. 564,658 filed Apr. 3, 1975 now U.S. Pat. No. 3,965,784, issued June 29, 1976.

BACKGROUND OF THE INVENTION

This invention relates to blanking dies, and holders accommodating the dies, which may be mounted on all types of punch presses, including those utilizing a turret.

DESCRIPTION OF THE PRIOR ART

Various mechanisms for using blanking dies and ejecting the cut blanks have been described in the prior art. U.S. Pat. Nos. 2,325,290; 2,444,946; 3,043,176; 3,656,380; and 3,777,601 may serve as examples. Such mechanisms have the purpose of stamping sheet metals into pieces, generally referred to in trade parlance as "part blanks", and to clear the blanks from the punch press or to deposit them at a remote location. These devices are conventional and may have various types of ejecting mechanisms. The die has the sole function of accepting the punch. The holder simply secures the die on whatever platform it may be placed.

In the present invention, as will be seen, there is a mechanical interaction between the die and the holder thereof. The latter does not merely serve as a container for the die.

SUMMARY OF THE INVENTION

It is the primary object of the invention to improve the construction of dies and, in particular, the holders thereof, that the latter may become a coactive functional assembly.

It is a salient feature of the invention that relatively thin die plates may be used in place of conventional massive structures, resulting in savings of material and production costs.

It is a particular advantage of the invention that the die holders herein described not only lend a solid support for the die during the blanking cycle, but are also instrumental in removal of the cut blank.

Other objects, features and advantages will be apparent from the following description of the invention, pointed out in particularity in the appended claims, and taken in connection with the accompanying drawings in which:

Figure 2:
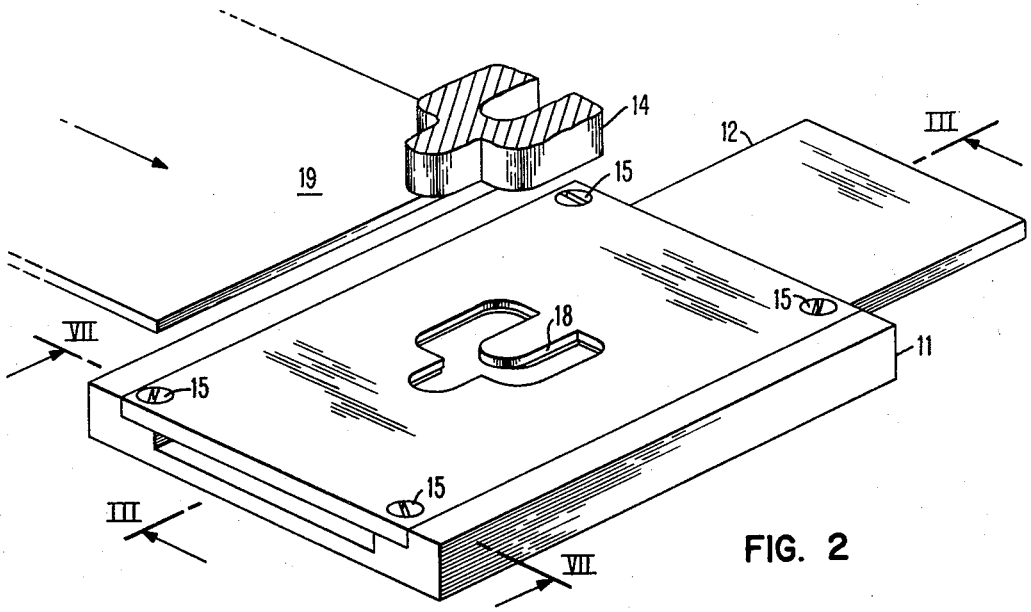
FIG. 2 is a perspective view of the embodiment shown in FIG. 1 in its assembled form.

FIGS. 3*a* through 3*e* are sectional views of the embodiment of FIG. 2 at various stages of operation. These views are taken along line III—III of FIG. 2.

Figure 4:
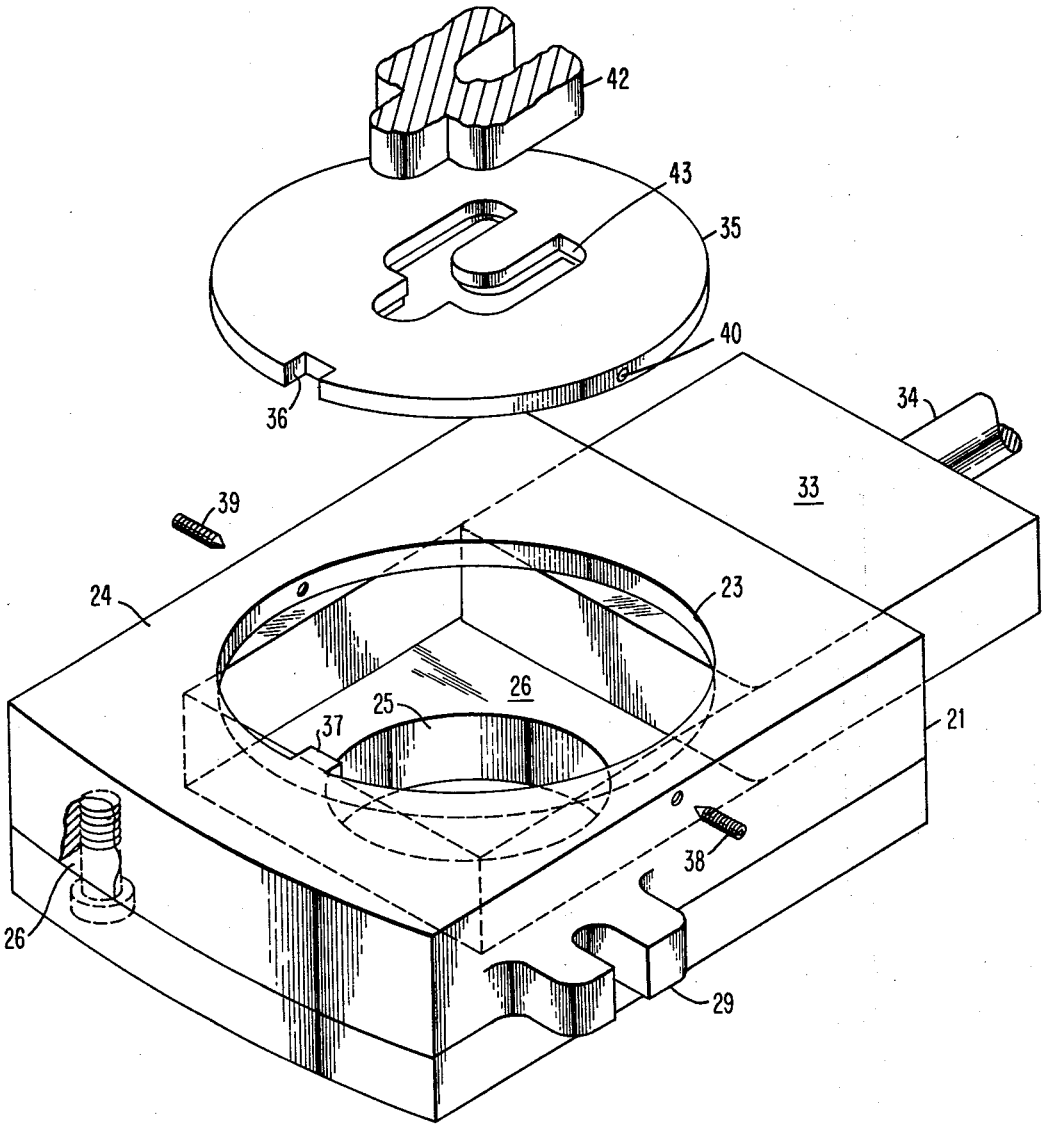

FIG. 4 is an exploded view, in perspective, illustrating a modification of a die holder and die plate for use particularly in turret-type punch presses.

Figure 5:
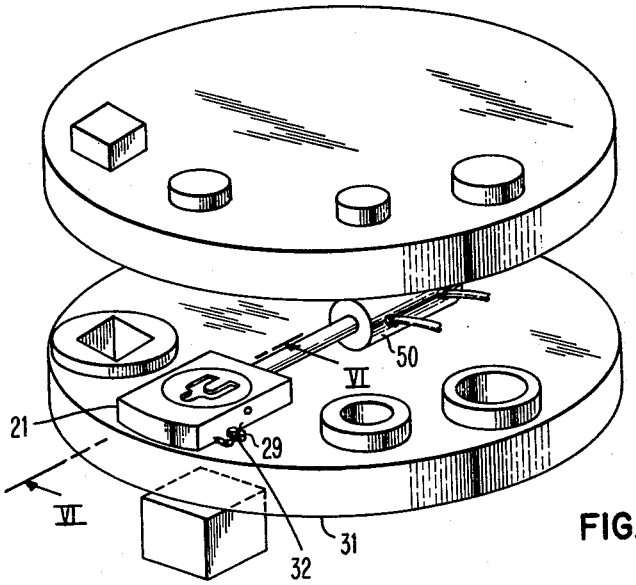

FIG. 5 illustrates the use of the die and holder assembly shown in FIG. 4 on the turret of a punch press.

Figure 6A:
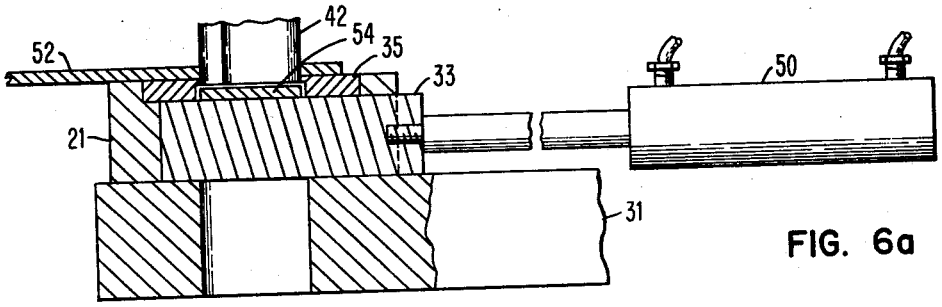

FIG. 6*a* is a partial sectional view along line VI of FIG. 5 showing the die and holder on the turret during blanking operation.

Figure 6B:
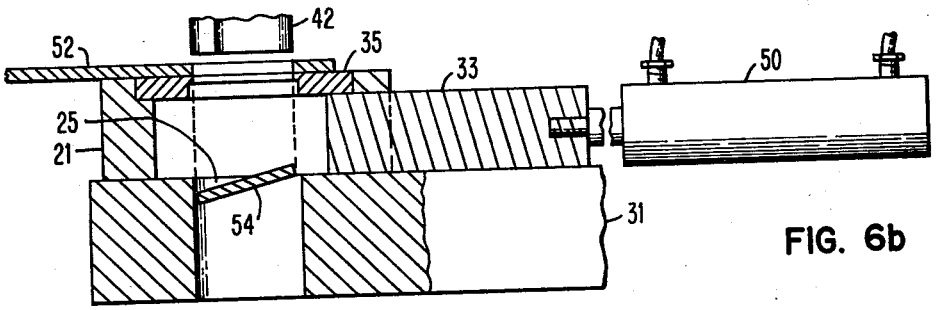

FIG. 6*b* is a similar view showing the die and holder upon withdrawal of the sliding block.

Figure 6C:
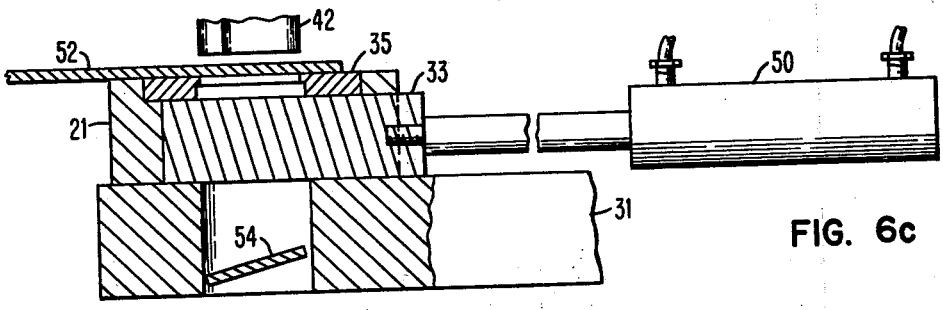

FIG. 6*c* is a view similar to FIG. 6*b* with the sliding block in the inward position ready for blanking operation.

Figure 7:
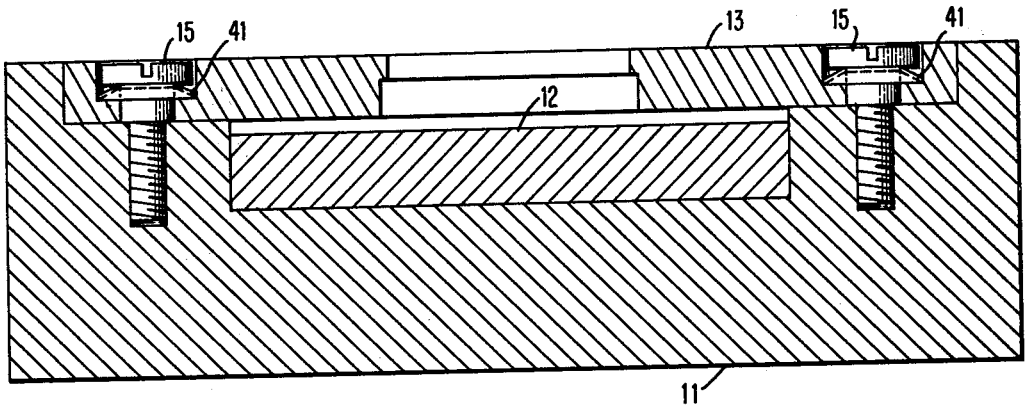

FIG. 7 is a cross-sectional view taken along line VII of FIG. 2 showing, in a highly exaggerated manner for the sake of illustration, that the die plate is resiliently mounted and a space is provided between the die and supporting plate to allow flexing of the die under impact.

Figure 8:
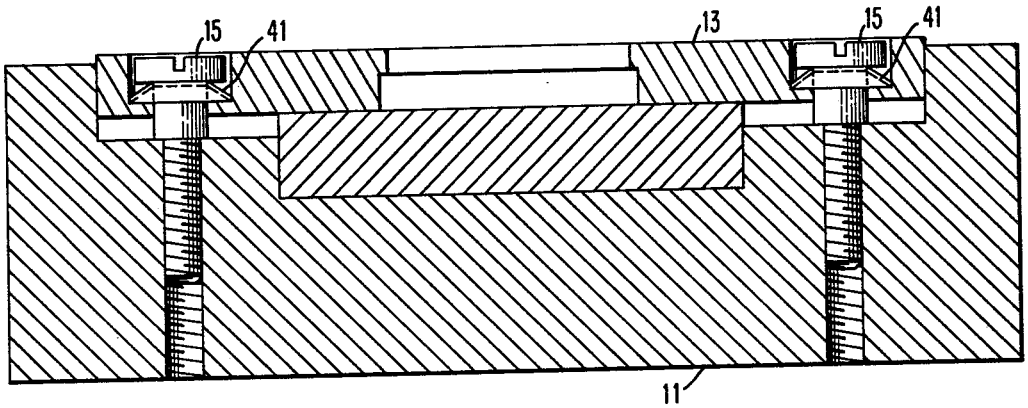

FIG. 8 is a view similar to FIG. 7 illustrating the operation of the resilient mounting of the die in the holder so as to permit vertical movement upon reduction of the space shown in FIG. 7. This feature permits lesser tolerance requirements in machining the support block.

DESCRIPTION OF THE PREFERRED EMBODIMENTS

Prior to a detailed consideration of the drawings, let us briefly examine the state of the art in general.

The purpose of a metal cutting die is to pierce or blank a regular or irregular contour of sheet metal in one powerful stamping impact of a punch. Obviously a die must be a solid block of hardened steel in order to withstand the impact of the punch. Depending upon the size of the blank to be cut and the thickness of material from which it is to be cut, conventional dies are generally made of hardened tool steel of considerable thickness. The solid metal portion, namely, the thickness, governs the strength of the die to withstand the enormous pressure to which it is subjected upon impact of the punch. The use of large blocks of steel for each die represents not only considerable material, but labor costs as well. Such dies are generally placed in simple holders which function merely as means for fastening the die over the platform of the punch press.

As will be seen from the detailed description which follows, by the use of the present invention, such dies may be reduced to one third or more of the normal size. This is achieved by the novel concept of utilizing a holder which, aside from being a support, is also operationally functional in the blanking process. In short, a die plate of relatively thin cross-section is placed in a novel holder which provides space beneath the die. Support means in the form of a sliding block or plate is so arranged as to move into this space and under the die during blanking operation.

Figure 1:
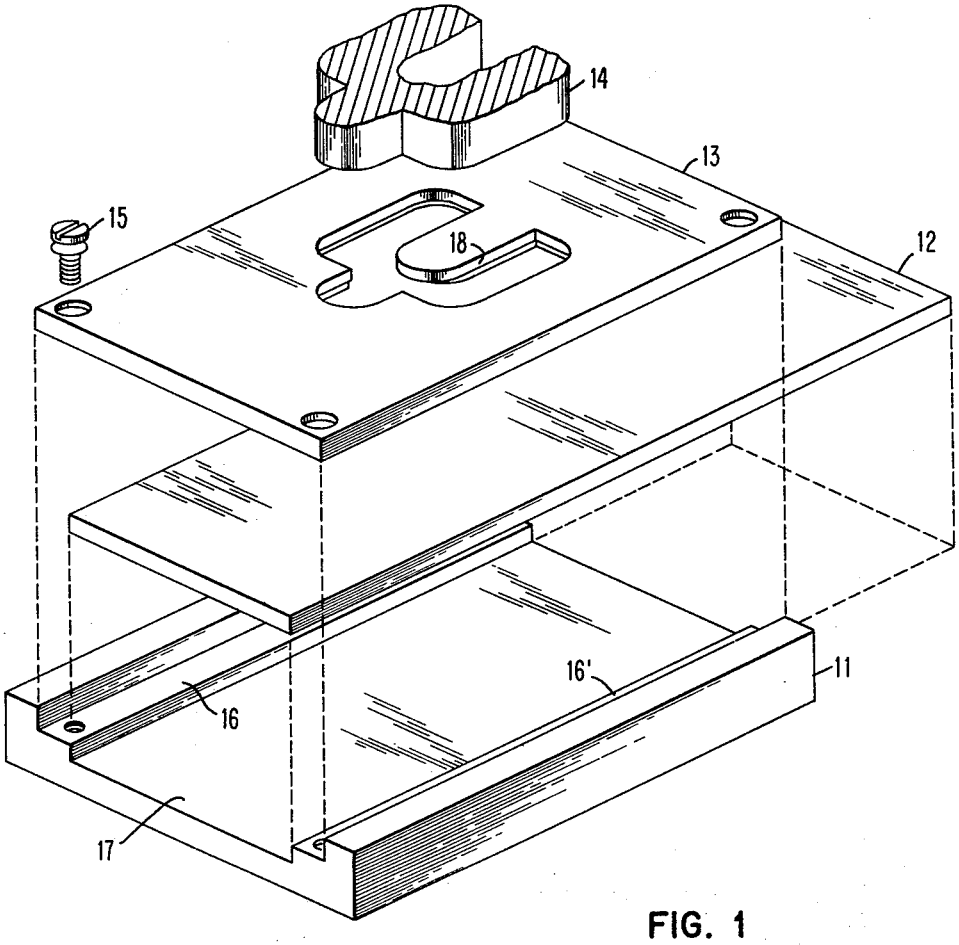
FIG. 1 is an exploded view, in perspective, of a die and holder construction for use in conventional punch presses.

Referring to the drawings, FIG. 1 depicts, in exploded perspective, the component elements of a blanking die incorporating the present invention, namely, a die holder 11, a shuttle plate 12, a die 13, and a spring-loaded shoulder bolt 15, all placed under a punch 14. When assembled, as in FIG. 2, a spring-biased shoulder bolt 15, shown more clearly in FIGS. 7 and 8, is inserted through each of the holes in the die 13 and into the threaded holes in the die holder 11. The die 13 rests on shelves 16 and 16' of the holder 11. The shuttle plate 12 is slidably supported between the upper inside surface 17 of the die holder 11 and the bottom face of the die 13. The vertical clearance between the die holder 11 and the shuttle plate 12, and between the latter and the die 13, is such that the shuttle plate 12 effectively supports the die during the blanking operation, giving added strength to the relatively thin die, particularly at the cutout portion 18, at the same time permitting the sliding movement of the shuttle plate 12 between the die holder 11 and the die 13.

Figure 3A:
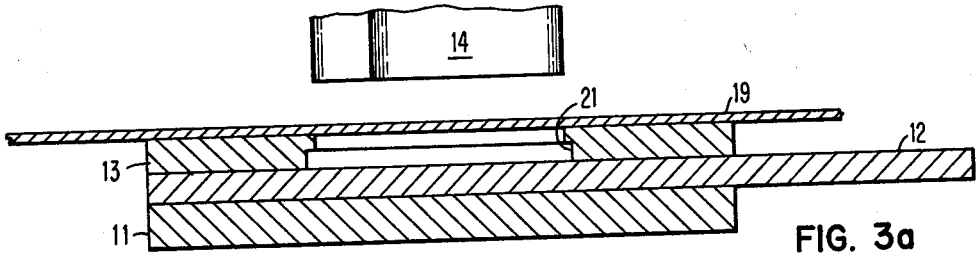
Figure 3B:
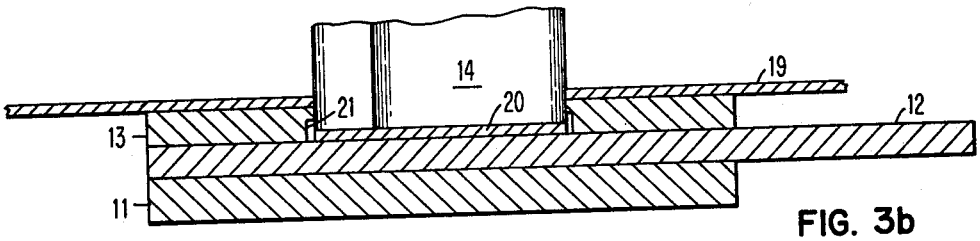
Figure 3C:
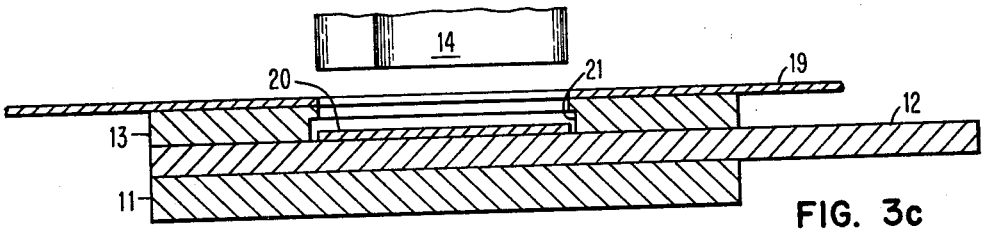
Figure 3D:
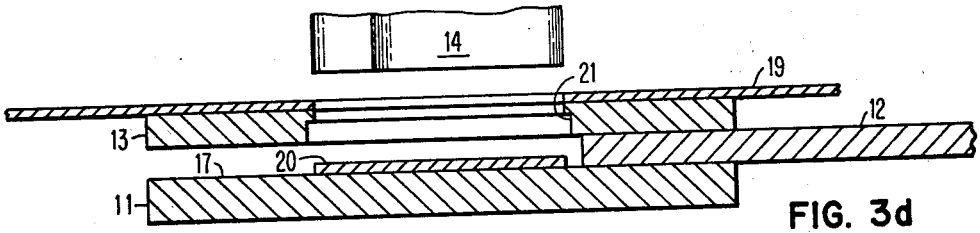
Figure 3E:
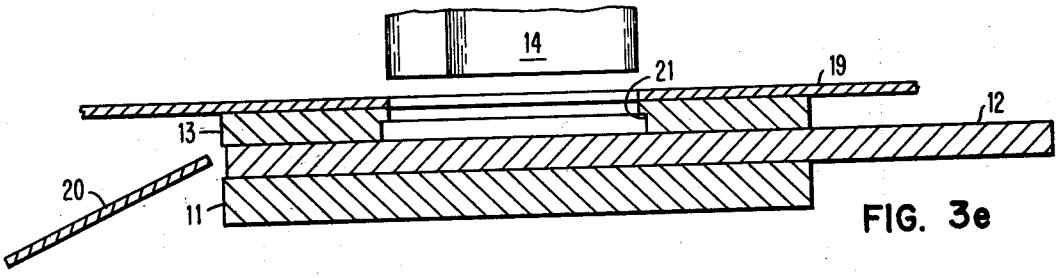

FIGS. 3*a* through 3*e* depict the blanking die in action. FIG. 3*a* shows the raw material 19 resting on the die 13 as the punch 14 is about to descend. FIG. 3*b* shows the punch 14 having cut through the material 19 and being thrust into the die opening and the part blank 20 resting on the shuttle plate 12. It is to be noted that an undercut or step 21 in the die 13 permits the part blank 20 to fall freely on the shuttle plate 12. In FIG. 3*c*, the punch 14 has been withdrawn from the die opening, and the part blank 20 continues to rest on the shuttle plate 12. In FIG. 3*d*, the shuttle plate 12 has been retracted by suitable means (not shown in the figures), causing the part blank 20 to fall to the upper surface 17 of the die holder 11. Finally, FIG. 3*e* shows the shuttle plate 12 having been returned to its initial position, forcing the part blank 20 out of the assembly.

In FIG. 4 a modified construction of the die and holder intended for use on turret-type punch presses is shown. The holder 21 is made of a solid block with a circular opening 23 in the top wall 24 and another similar, but smaller, opening 25 in the bottom wall 26. Clamping lugs, such as 29, are provided for fastening the holder 21 to any suitable platform. Within the holder 21 is a sliding support block 33 attached to a shaft 34. The latter may be used with an air cylinder as will be seen later.

The thin die plate 35 is disk-shaped, having the proper diameter to fit into the opening 23 of the holder 21. A cutout 36 locates the die 35 in the wall 24 by means of a lip 37. After the die is inserted, simple set screws 38 and 39 are used to engage indentations, such as 40, in the rim of the die plate 35. Partially shown is the punch 42 which has the configuration of the die opening 43.

FIG. 5 is a schematic showing of the turret portion 31 of a multistation turret punch press employing at one station a blanking die and holder combination such as shown in FIG. 4. In this application, the bottom wall 24 may be removed and the turret 31 may serve this purpose since the holder 21 is firmly secured thereto by the lugs 29 and suitable bolts 32.

In the embodiment shown, an air cylinder 50 is utilized as a means for sliding the support block 33 in both directions. It is seen that the turret 31 can accommodate several types of holders in addition to the holder 21 of the present invention.

FIG. 6*a* is a cross sectional view showing the sliding block 33 in the fully inward position, the punch 42 having cut through the raw material 52. As seen, the die plate 35 is supported by the sliding block 33 and the part blank 54 is now resting on the surface thereof.

In the next sequence of operation, as shown in FIG. 6*b*, the air cylinder 5 has withdrawn the sliding block 33 so that the part blank 54 is falling, simply by gravity, through the opening 25 of the holder 21 and through the opening generally provided in the turret 31.

In the next sequence of operation, as shown in FIG. 6*c*, the sliding block 33 is again pushed inwardly ready for the punch 42 to stamp the next part blank from the sheet material 52. Thus the blanking sequences continue.

The important thing to note is that every time the punch 42 makes its inward excursion, the thin die plate 35 is supported by means of the sliding block 33, giving the strength that the die 35 would have were it a solid and massive block as is the case with conventional dies.

FIG. 7 illustrates, in an enlarged view, the section taken along line VII of FIG. 1. It is seen that the die 13 is resiliently mounted in the holder 11 by means of shoulder bolts 15 which have a spring circular collar 41 so that the die may have some movement in the vertical axis. A narrow space may be provided between the shuttle plate 12 and the die 13 so that the shuttle plate 12 need not be machined to close tolerances. The tolerance requirement, without this feature, would be 2/1000 of an inch.

As seen in FIG. 8, should the shuttle plate 12 have greater thickness, the die 13 may move against the spring bias provided by the collars 41 of bolts 15 so that it may be slightly above the normal surface of the holder 11. This in no way interferes with normal operation.

It should be remembered also that the die plate 13, being of relatively thin cross-section, has the ability to flex during blanking operation. This flexing is an important feature of the present invention. Conventional dies do not have such capability and this is the reason that such dies must be made of solid and massive blocks of steel.

The invention in its broader aspects is not limited to the specific embodiments herein shown and described but changes may be made within the scope of the accompanying claims without departing from the principles of the invention and without sacrificing its chief advantages.

What is claimed is:

1. A blanking die holder for supporting a relatively thin die plate into which a punch of a press forces material during blanking of parts blanks, said die holder comprising:

a housing including a bottom and upstanding walls, said walls defining a circular opening which receives and supports said thin die plate, said wall having an inwardly extending lip and inwardly extending set screws, said lip and set screws extending into said circular opening to engage a radially inwardly extended cutout and circumferentially spaced indentations, respectively on said die plate which is disk shaped;

a slidable support block, said support block being cyclically movable into a space within said housing defined by said die plate, walls, and bottom, said support block underlying said thin die plate to support said die plate during blanking of the parts; and an opening in the bottom of said housing to allow gravitational removal of the parts blanks upon the movement of said support block out of said space under said die plate.

* * * * *